US006413122B2

(12) United States Patent
Fujioka

(10) Patent No.: US 6,413,122 B2
(45) Date of Patent: Jul. 2, 2002

(54) WRONG INSERTION PREVENTING MECHANISM

(75) Inventor: Shintaro Fujioka, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/740,856

(22) Filed: Dec. 21, 2000

(30) Foreign Application Priority Data

Dec. 22, 1999 (JP) ..... 10-363685

(51) Int. Cl.[7] ..... H01R 13/64

(52) U.S. Cl. ..... 439/680; 361/796; 439/327; 439/681

(58) Field of Search ..... 439/680, 681, 439/377, 378, 633, 64, 153, 327, 328, 325; 361/752, 754, 756; 369/798, 802, 801

(56) References Cited

U.S. PATENT DOCUMENTS 4,547,835 A * 10/1985 Pansaerts et al. ..... 361/399
4,644,444 A * 2/1987 Rush ..... 361/388
4,869,680 A * 9/1989 Yamamoto et al. ..... 439/327
5,293,303 A * 3/1994 Fletcher et al. ..... 361/798
5,317,480 A * 5/1994 Chandraiah et al. ..... 361/785
5,318,463 A * 6/1994 Broschard, III et al. .... 439/540
5,793,614 A * 8/1998 Tollbom ..... 361/732
5,978,233 A * 11/1999 Roscoe et al. ..... 361/796
6,147,872 A * 11/2000 Roy ..... 361/754
6,220,879 B1 * 4/2001 Ulrich ..... 439/160
6,266,253 B1 * 7/2001 Kurrer et al. ..... 361/796

* cited by examiner

*Primary Examiner*—P. Austin Bradley
*Assistant Examiner*—Ross Gushi
(74) *Attorney, Agent, or Firm*—Whitham, Curtis & Christofferson, PC

(57) ABSTRACT

A wrong insertion preventing mechanism for preventing a connector of a wrong board from being connected to a connector mounted on a mother board on a shelf is disclosed. A guide plate is installed at the opening of the shelf and has plural through holes mutually having different shapes. A guide pin which can be inserted into a specific through hole of the through holes of the guide plate is mounted on a board. The board is inserted in a right position on the shelf by the through hole and the guide pin and is never inserted onto the shelf from a wrong position. The guide pin has a projection at the end and the projection can be set to various angles.

13 Claims, 12 Drawing Sheets

WRONG INSERTION PREVENTING MECHANISM

BACKGROUND OF THE INVENTION

1. Field of the Invention

The present invention relates to a wrong insertion preventing mechanism, particularly relates to a mechanism for preventing a wrong connector of a printed wiring board from being inserted into a connector mounted on a mother board in a cabinet.

2. Description of the Related Prior Art

Recently, various electronic equipments have configuration that plural plug-in units are housed on a shelf also called a subrack (hereinafter called a shelf). Such electronic equipment is provided with proper functions when a plug-in unit is installed in a right position on a shelf. In case a plug-in unit is not set in a right position, electronic equipment cannot acquire required functions and in addition, the plug-in unit may be broken. A plug-in unit includes a printed wiring board, a connector mounted on the board and a lever (an ejector) operated when the board is detached/attached from/to a connector of a shelf. Normally, of connected connectors, one receptacle connector is mounted on a mother board on a shelf and the other plug connector is installed in a plug-in unit. To prevent connectors from being wrongly inserted, a wrong insertion preventing component is installed in the vicinity of the connector. For example, a wrong insertion preventing component having the L-type section is installed in the vicinity of a receptacle connector and a wrong insertion preventing component having the L-type section is also installed in the vicinity of a plug connector corresponding to the component. The respective L-type wrong insertion preventing components of a receptacle connector and a plug connector to be electrically connected are installed so that its concave portion and its convex portion are fitted when the connectors approach. Also, the respective L-type wrong insertion preventing components of a receptacle connector and a plug connector to be not electrically connected are installed so that its convex portion and its concave portion mutually bump when the connectors approach. When a plug-in unit is inserted in a right position of a shelf, two L-type wrong insertion preventing components do not bump and therefore, a right plug connector is connected to a receptacle connector. When a plug-in unit is inserted in a wrong position of a shelf, the convex portions of two L-type wrong insertion preventing components mutually bump and the plug-in unit is not inserted moreover. Therefore, a receptacle connector is not connected to a wrong plug connector.

However, the conventional type wrong insertion preventing mechanism described above has the following problems. As electronic equipment is recently provided with many functions and becomes complex, the number of pins of a connector of a printed wiring board is greatly increased. Therefore, large force is required to connect connectors. Force required for insertion per pin of a certain type of connector is approximately 500 mN (millinewton) for example and in the case of a plug connector having 1000 pins, approximately 500 N is required for connecting the connector. Therefore, a conventional type plug-in unit is provided with an ejector that connects connectors. Normally, when wrong insertion preventing components installed in the vicinity of each connector bump, an operator already starts operation for connecting connectors by an ejector and it is difficult to detect resistance force caused when the wrong insertion preventing components bump. Therefore, the wrong insertion preventing components are broken or connectors are connected by mistake. For another problem, the combination of wrong insertion preventing components is limited. That is, as the combination in the number, the installed position and the orientation of the L-type wrong insertion preventing components described above is limited, the increase of the number of plug-in units installed on a shelf cannot be met. Also, a connector in which a wrong insertion preventing component cannot be set is used in large numbers.

SUMMARY OF THE INVENTION

Therefore, the object of the invention is to provide a wrong insertion preventing mechanism which can detect wrong insertion before a connector on a shelf and a connector of a plug-in unit are touched, can sufficiently correspond to the increase of the number of plug-in units and further, can be applied to many types of connectors.

To achieve the object, the wrong insertion preventing mechanism is provided with a guide pin holder attached to a board having a connector, a guide pin held in the guide pin holder so that the guide pin can be detached and a guide plate having a through hole which is made at the opening of the shelf having the connector and which a specific guide pin can pierce.

In a concrete example of the wrong insertion preventing mechanism, the guide plate has plural through holes and each specific guide pin pierces each through hole. In another concrete example, a projection is formed at the end of the guide pin in a radial direction of the guide pin, the projection is formed in any of predetermined plural positions in the guide pin holder and plural through holes formed in the guide plate respectively have a shape corresponding to a specific position in which the projection of the guide pin is formed. The wrong insertion preventing mechanism can be provided with a lever attached to the board so that the lever can be turned, the lever can connect the connector of the board to the connector on the shelf by being turned and pressing the guide plate and can pull out the connector of the board from the connector on the shelf by being turned and pressing the guide plate. In the wrong insertion preventing mechanism, connectors to be connected can be securely connected.

BRIEF DESCRIPTION OF THE DRAWINGS

The above and other objects, features and advantages of the present invention will become apparent from the following detailed description when taken with the accompanying drawings in which.

DETAILED DESCRIPTION OF THE PREFERRED EMBODIMENTS

Figure 1A:
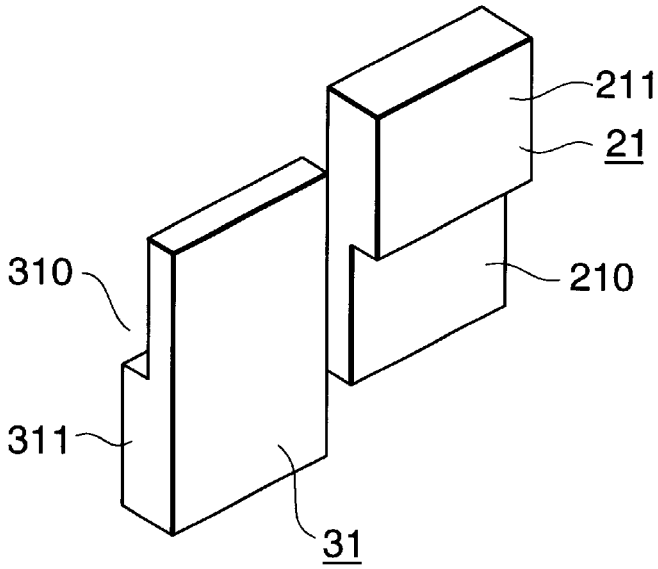
FIG.1A PRIOR ART
FIGS. 1A and 1B are perspective views respectively showing conventional type wrong insertion preventing components.
Figure 1B:
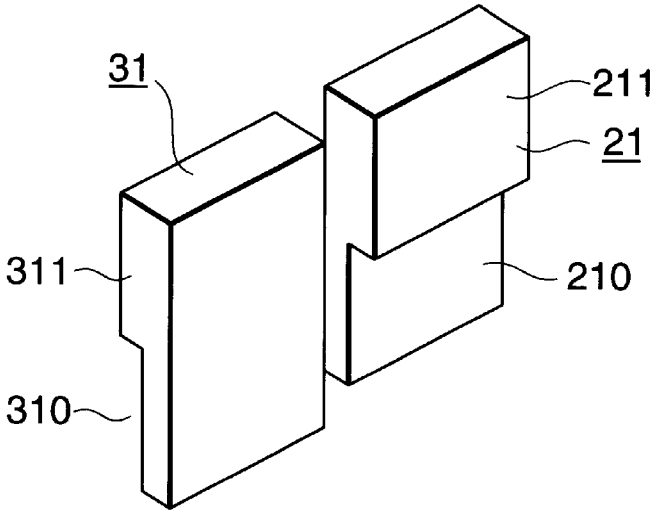
FIG.1B PRIOR ART

Referring to FIGS. 1A and 1B, each section in a direction in which a connector is inserted of conventional type wrong insertion preventing components 21 and 31 is L-shaped. In arrangement shown in FIG. 1A, as the convex portion and the concave portion of the components are mutually opposite, they do not bump each other and are mutually fitted. In arrangement shown in FIG. 1B, as the convex portion and the convex portion of the components and the concave portion and the concave portion of the components are opposite, they bump each other.

Figure 2A:
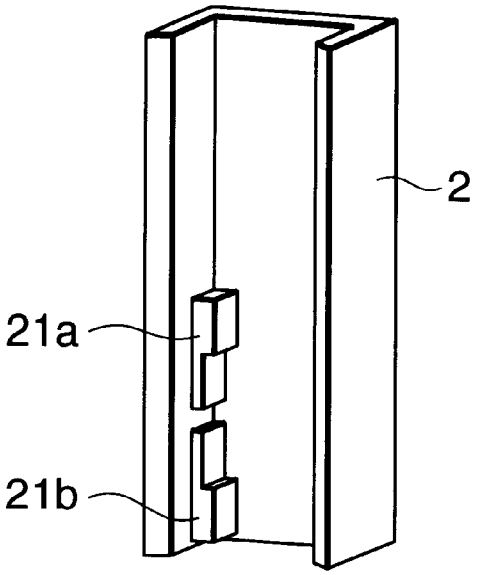
FIG.2A PRIOR ART
FIGS. 2A and 2B are perspective views showing conventional type receptacle connector and plug connector respectively provided with wrong insertion preventing components.
Figure 2B:
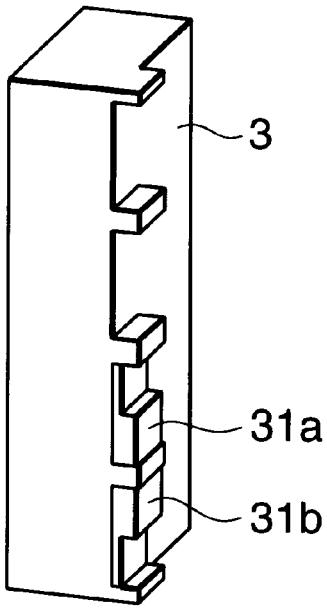
FIG.2B PRIOR ART

Referring to FIGS. 2A and 2B, a conventional type receptacle connector 2 is provided with L-type wrong insertion preventing components 21*a* and 21*b* and a plug connector 3 is similarly provided with L-type wrong insertion preventing components 31*a* and 31*b*. The receptacle connector 2 is mounted on a mother board on the inside of a shelf and the plug connector 3 is inserted into a plug-in unit inserted onto the shelf.

Figure 3:
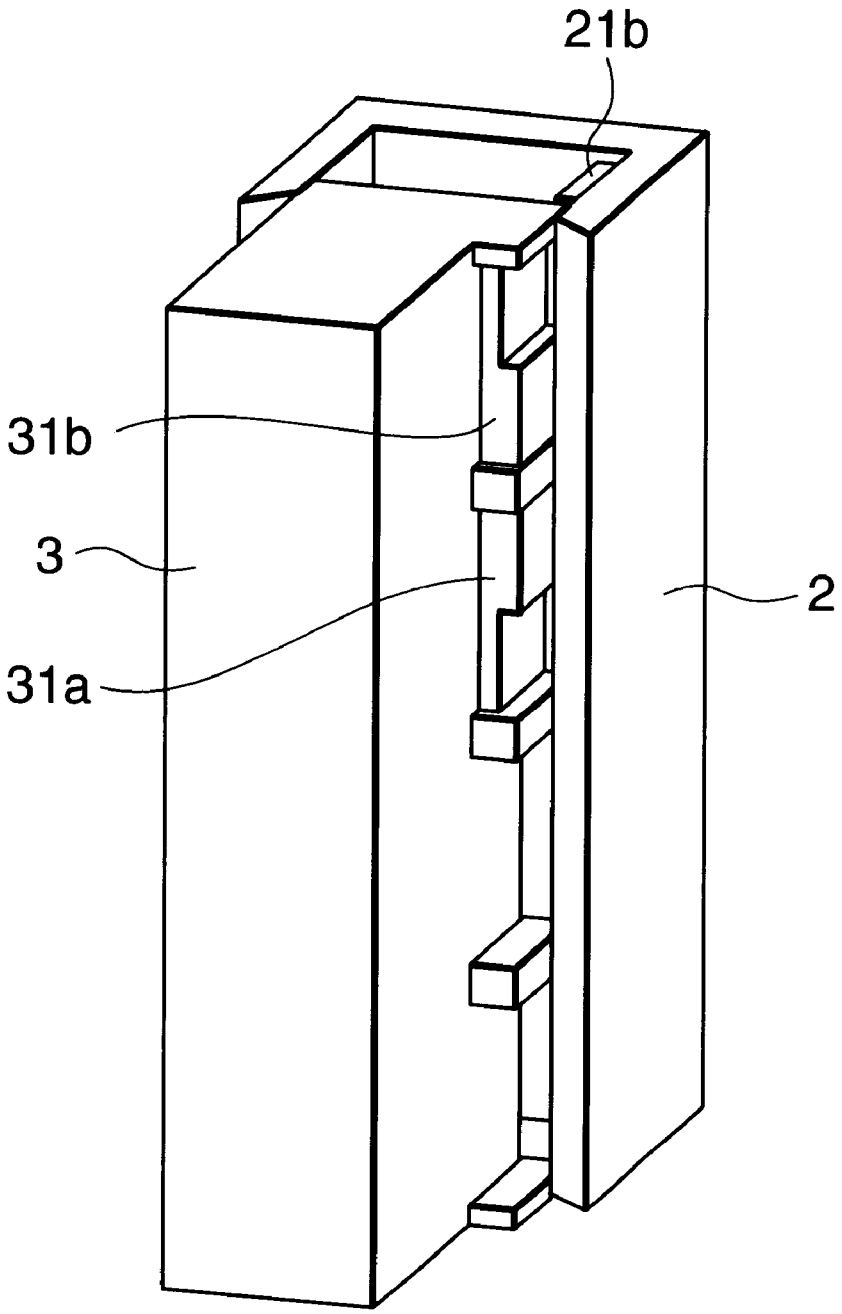
FIG.3 PRIOR ART
FIG. 3 is a perspective view showing a receptacle connector and a plug connector mutually touched.

FIG. 3 shows arrangement in which the receptacle connector 2 and the plug connector 3 can be connected. At this time, the L-type wrong insertion preventing components 21*a* and 21*b* and the L-type wrong insertion preventing components 31*a* and 31*b* are mutually fitted.

Figure 4:
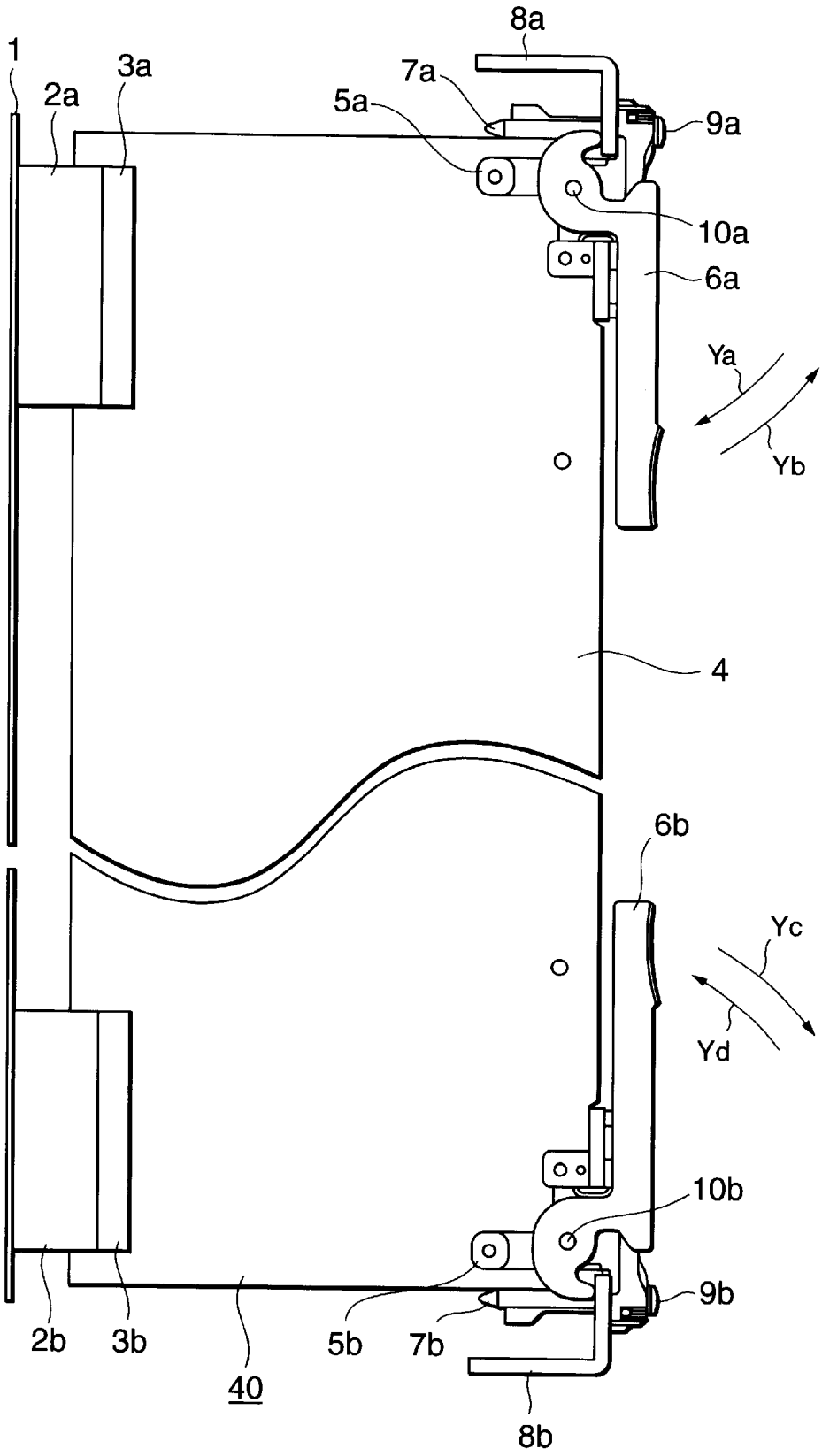
FIG. 4 is a plan view showing a plug-in unit provided with a wrong insertion preventing mechanism according to the invention.
Figure 5:
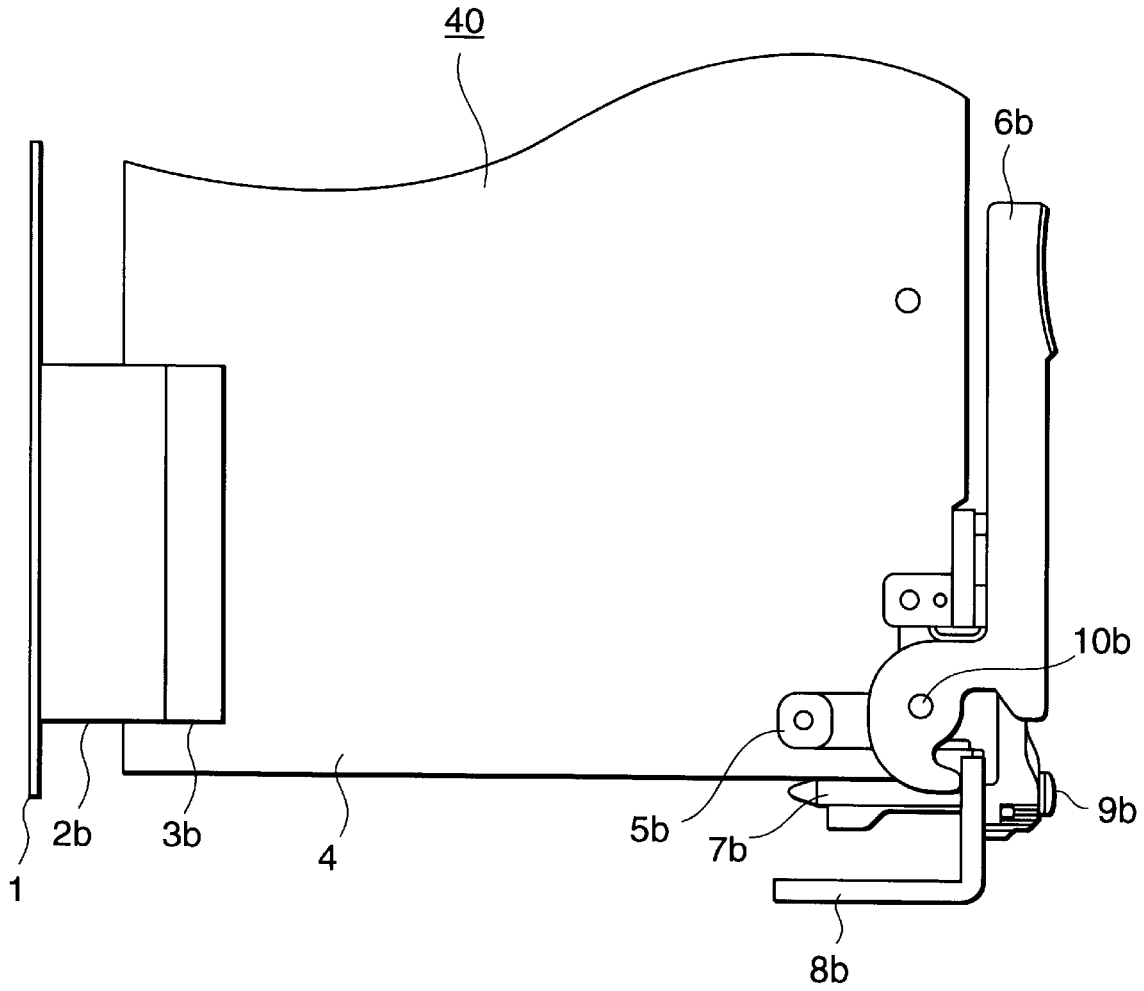
FIG. 5 is a partial enlarged view showing the plug-in unit provided with the wrong insertion preventing mechanism according to the invention.

FIG. 4 shows an example of a plug-in unit 40 to which a wrong insertion preventing mechanism according to the invention is applied. FIG. 5 is a partial enlarged view of FIG. 4. The plug-in unit 40 is provided with a printed circuit board 4 and plug connectors 3*a* and 3*b*. The plug connectors 3*a* and 3*b* are respectively connected to receptacle connectors 2*a* and 2*b* mounted on a mother board 1 provided on a shelf (not shown). The printed wiring board 4 is provided with bases 5*a* and 5*b* respectively fixed with a screw at its two corners. The bases 5*a* and 5*b* are respectively provided with a guide pin holding hole for respectively holding guide pins 7*a* and 7*b* by screws 9*a* and 9*b*. The bases 5*a* and 5*b* are respectively provided with ejectors 6*a* and 6*b* and these ejectors are respectively supported by pins 10*a* and 10*b* so that the ejectors can be turned in directions of Ya, Yb and Yc and Yd respectively shown in FIG. 4. In FIGS. 4 and 5, the guide pins 7*a* and 7*b* respectively pierce through holes of guide plates 8*a* and 8*b* respectively installed at the opening of the shelf. In the wrong insertion preventing mechanism according to the invention, the guide pin and the guide plate having the through hole are basic components.

Figure 6:
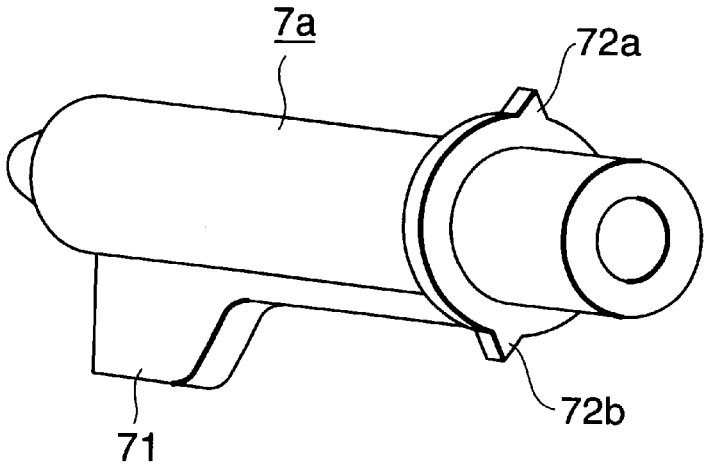
FIG. 6 is a perspective view showing a guide pin.

Referring to FIG. 6, the guide pin 7*a* in one example of the invention is provided with a plate projection 71 (hereinafter called a flag) in the vicinity of one end and two projections 72*a* and 72*b* in the vicinity of the other end.

Figure 7:
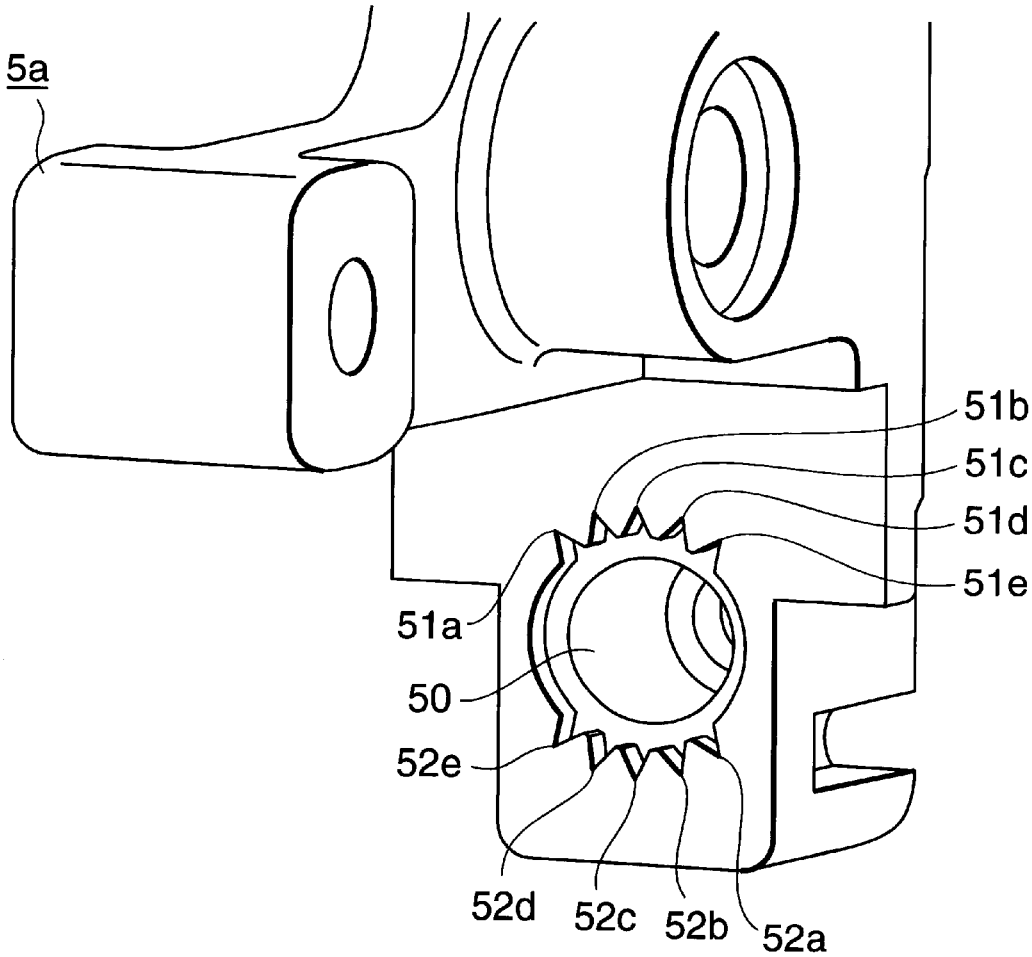
FIG. 7 is an enlarged perspective view showing a guide pin holder.

FIG. 7 shows a guide pin holding hole 50 of the base 5*a*. The guide pin holding hole 50 is circular and plural slits 51*a* to 51*e* and 52*a* to 52*e* are radially formed along the periphery. The shape and the position of these slits correspond to the projections 72*a* and 72*b* of the guide pin. When the projections 72*a* and 72*b* of the guide pin are inserted into predetermined slits, the flag 71 of the guide pin is set at a specific angle. After the guide pin 7*a* is inserted into the guide pin holding hole 50 at a predetermined angle, it is fixed by the screw 9a.

Figure 8:
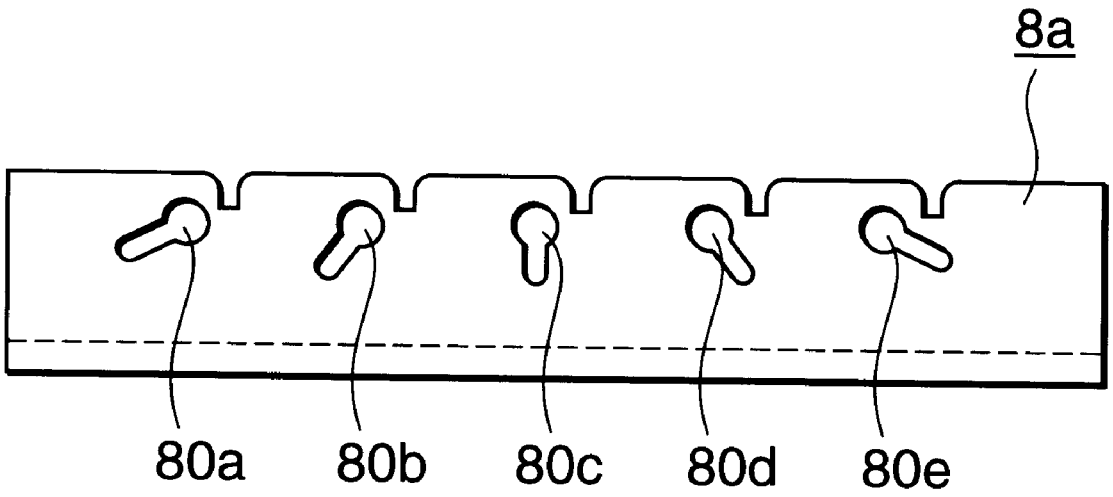
FIG. 8 is a front view showing a guide plate.

Referring to FIG. 8, the guide plate 8*a* is provided with five through holes 80*a* to 80*e* for example. Each through hole has a shape corresponding to the section at the end at which the flag 71 is formed of the guide pin 7*a*. However, each through hole 80*a* to 80*e* is different in the position of a concave portion corresponding to the flag 71. That is, each through hole 80*a* to 80*e* passes only the guide pin the flag of which is set at a specific angle. When the projections 72*a* and 72*b* of the guide pin 7*a* are respectively inserted into the slits 51*c* and 52*c* of the guide pin holding hole 50, the guide pin 7*a* can pierce only the through hole 80*c* of the guide plate 8*a* shown in FIG. 8. Similarly, when the projections 72*a* and 72*b* of the guide pin 7*a* are respectively inserted into the slits 51*a* and 52*a* of the guide pin holding hole 50, the guide pin 7*a* can pierce only the through hole 80*a*. For the other through holes, the guide pin having the flag set at a specific angle can be also inserted into only the specific through hole. Therefore, relationship between the guide pin having the flag and the through hole of the guide plate is similar to that between a key and a keyseat. For example, in case the specific printed wiring board 4 is connected to the receptacle connector 2*a* installed in a position corresponding to the through hole 80*c* of the guide plate, the plug connector 3*a* which can be inserted into the receptacle connector 2*a* is installed on the printed wiring board 4 and the guide pin 7*a* is set in the guide pin holding hole 50 so that the position of the flag 71 pierces the through hole 80*c* of the guide plate. The guide pin of the plug-in unit set as described above cannot pierce the other through holes of the guide plate and wrong insertion is prevented. In the example shown in FIG. 4, the guide plate is respectively installed in upper and lower parts (on paper space of FIG. 4) of the opening of the shelf. The plug-in unit 40 is provided with bases 5*a* and 5*b* and the guide pins 7*a* and 7*b* at the two corners corresponding to these guide plates. In case the types in the shape of the through holes of the guide plate are limited, the shelf provided with the two guide plates can house more plug-in units than the shelf provided with one guide plate. This reason is that many types of combinations of the guide plate through holes can be formed. The shape of the through holes of the guide plate can be changed by changing the sectional shape of the flag for example. The angles of the flag may be set to more than five types.

Next, operation for inserting the plug-in unit on the shelf and pulling out it from the receptacle connector on the shelf will be described.

Figure 9:
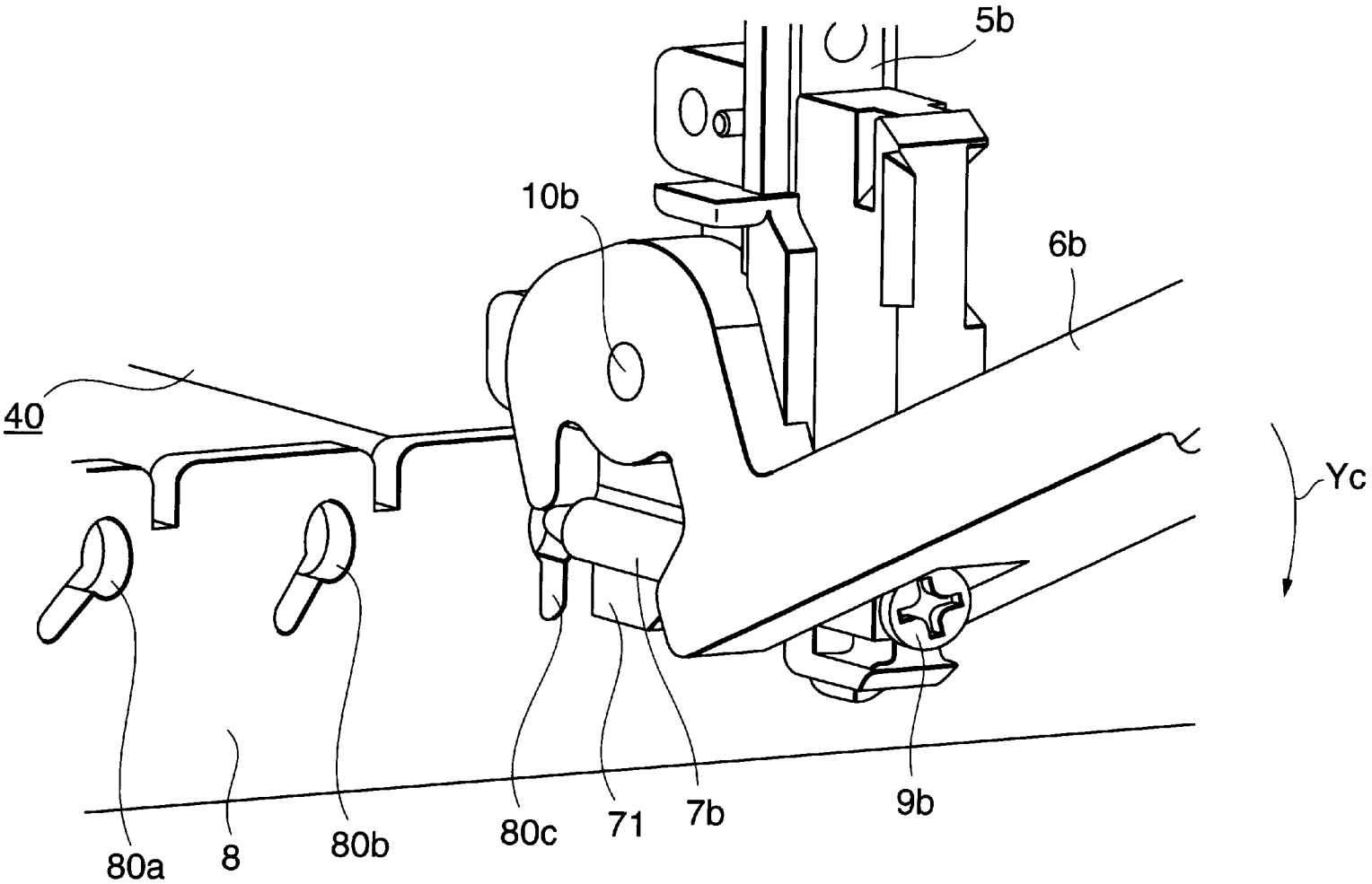
FIG. 9 is an enlarged perspective view showing the wrong insertion preventing mechanism according to the invention.

As shown in FIG. 9, the flag 71 of the guide pin 7*b* held on the base 5*b* of the plug-in unit 40 is set so that the flag corresponds to the through hole 80*b* of the guide plate 8. A part of the plug-in unit 40 is inserted into a slit in the vicinity of the through hole 80*b* and most is inserted onto the shelf (not shown). The guide pin 7*b* is not inserted into the through hole 80*b* yet. In such arrangement, when the plug-in unit 40 is further inserted, the ejector 6*b* supported on the base 5*b* by the pin 10*b* bump the guide plate 8 and the plug-in unit 40 is not inserted. Then, the ejector 6*b* is turned in a direction of Yc shown in FIG. 9.

Figure 10:
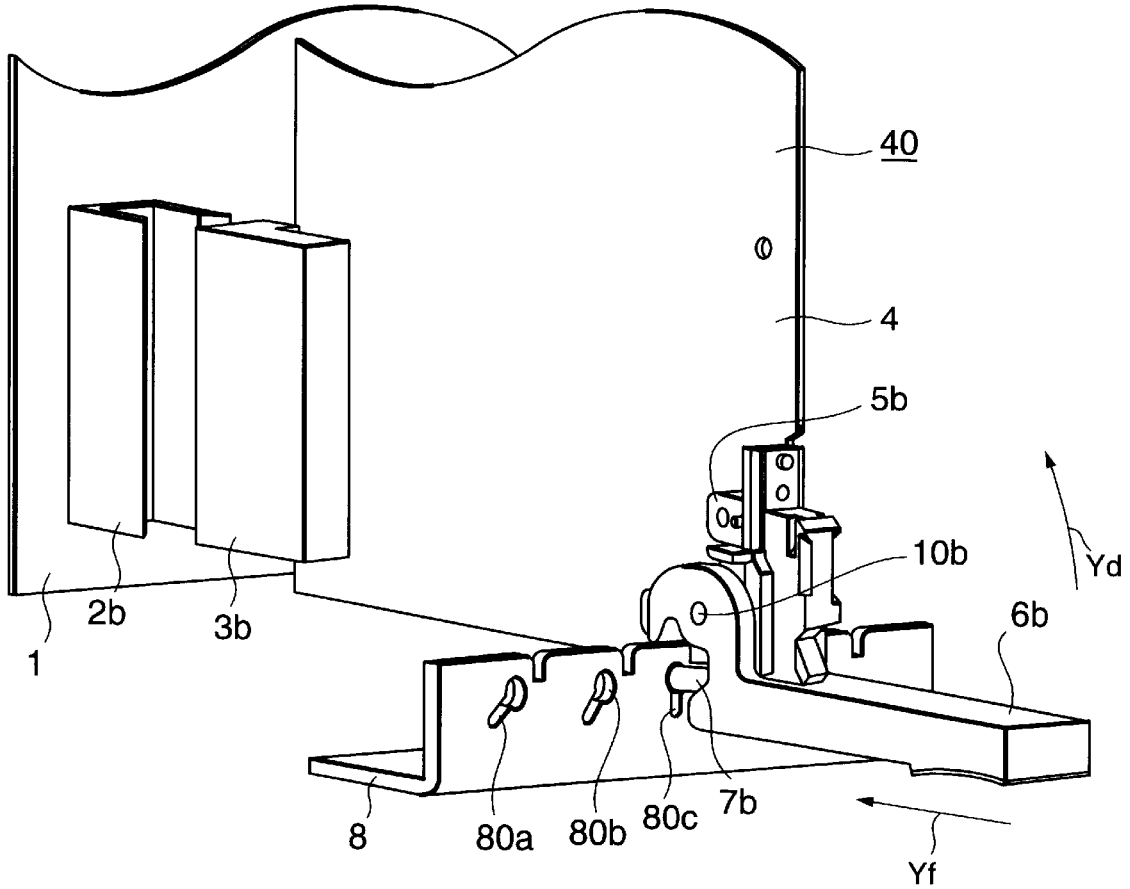
FIG. 10 is a perspective view showing the insertion operation of the plug-in unit provided with the wrong insertion preventing mechanism.

In FIG. 10, the ejector 6*b* is turned in the direction of Yc and is in a position in which the ejector does not bump the guide plate 8. At this time, when the plug-in unit 40 is moved in a direction of Yf shown in FIG. 10, the guide pin 7*b* pierces the through hole 80*b* of the guide plate 8 and the plug-in unit 40 is further inserted onto the shelf.

Figure 11:
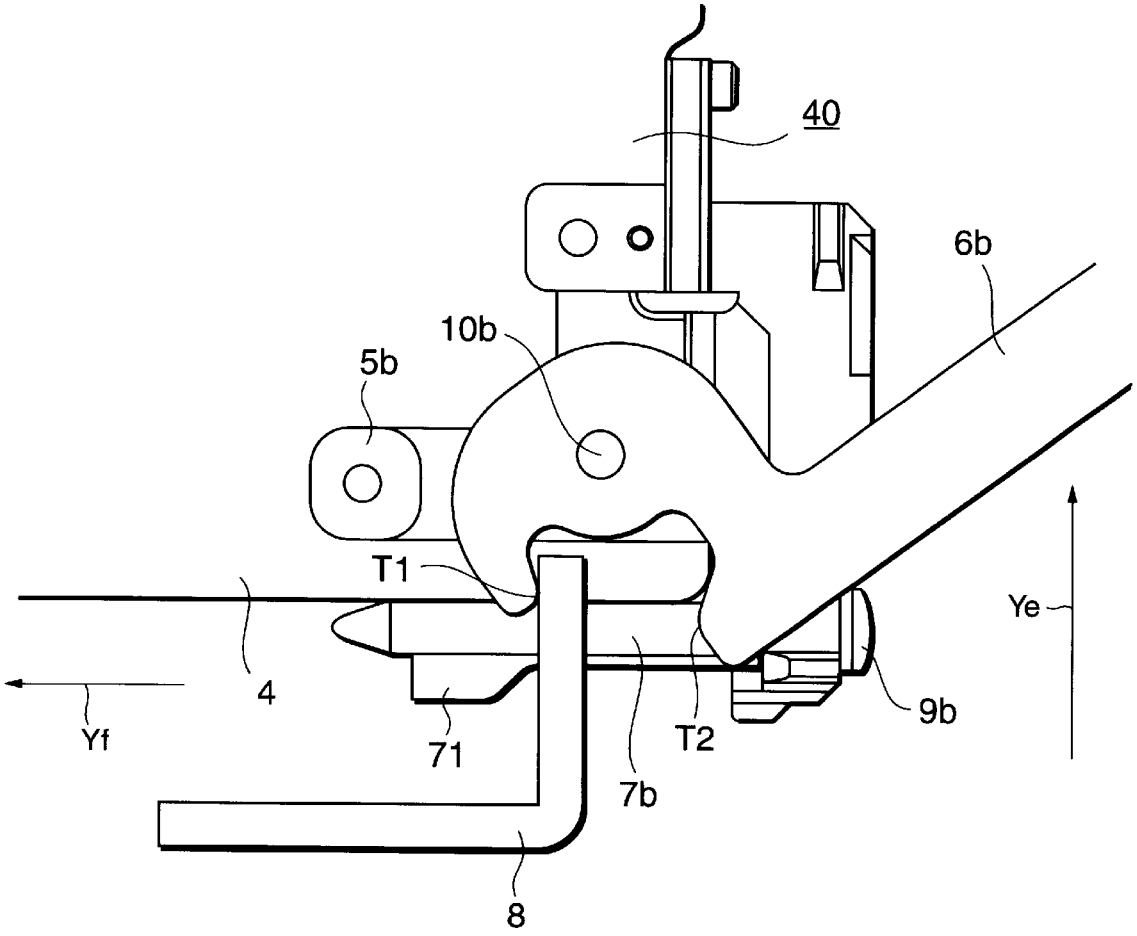
FIG. 11 is a side view showing the operation of an ejector.

FIG. 11 shows the arrangement of the ejector 6*b*, the guide pin 7*b*, the guide plate 8 and others when the plug-in unit 40 is inserted onto the shelf, the guide pin 7*b* pierces the through hole and the receptacle connector 2*b* and the plug connector 3*b* approach. Afterward, the ejector 6*b* is operated so that these connectors are mutually connected. When the ejector 6*b* is pushed in a direction of Ye shown in FIG. 11, it is turned with the pin 10*b* in the center, the end T1 presses the guide plate 8 and the plug-in unit 40 receives force in a direction of Yf. As a result, the plug connector 3*b* of the plug-in unit 40 is inserted into the receptacle connector 2*b* and is connected to it.

Figure 12:
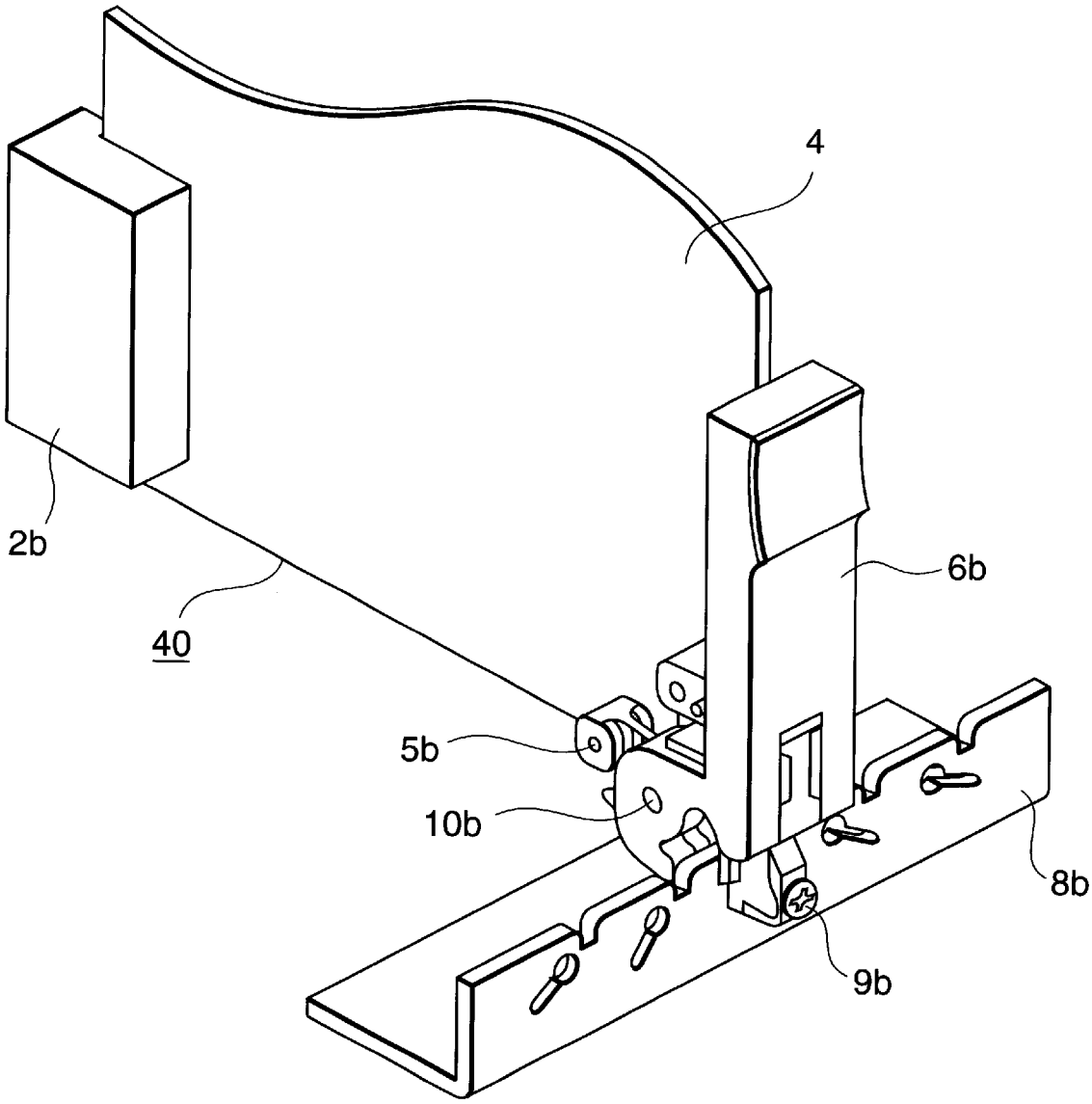
FIG. 12 is a perspective view showing the plug-in unit inserted into a plug connector.

FIG. 12 shows the plug-in unit 40 connected to the receptacle connector 2*b* after the operation of the ejector 6*b*. Afterward, to release the electric connection of the connectors, the ejector 6*b* is turned in a direction reverse to the direction of Ye shown in FIG. 11. Then, the end T2 of the ejector 6*b* presses the guide plate 8 and applies stress in a direction reverse to Yf shown in FIG. 11 to the plug-in unit 40.

Figure 13:
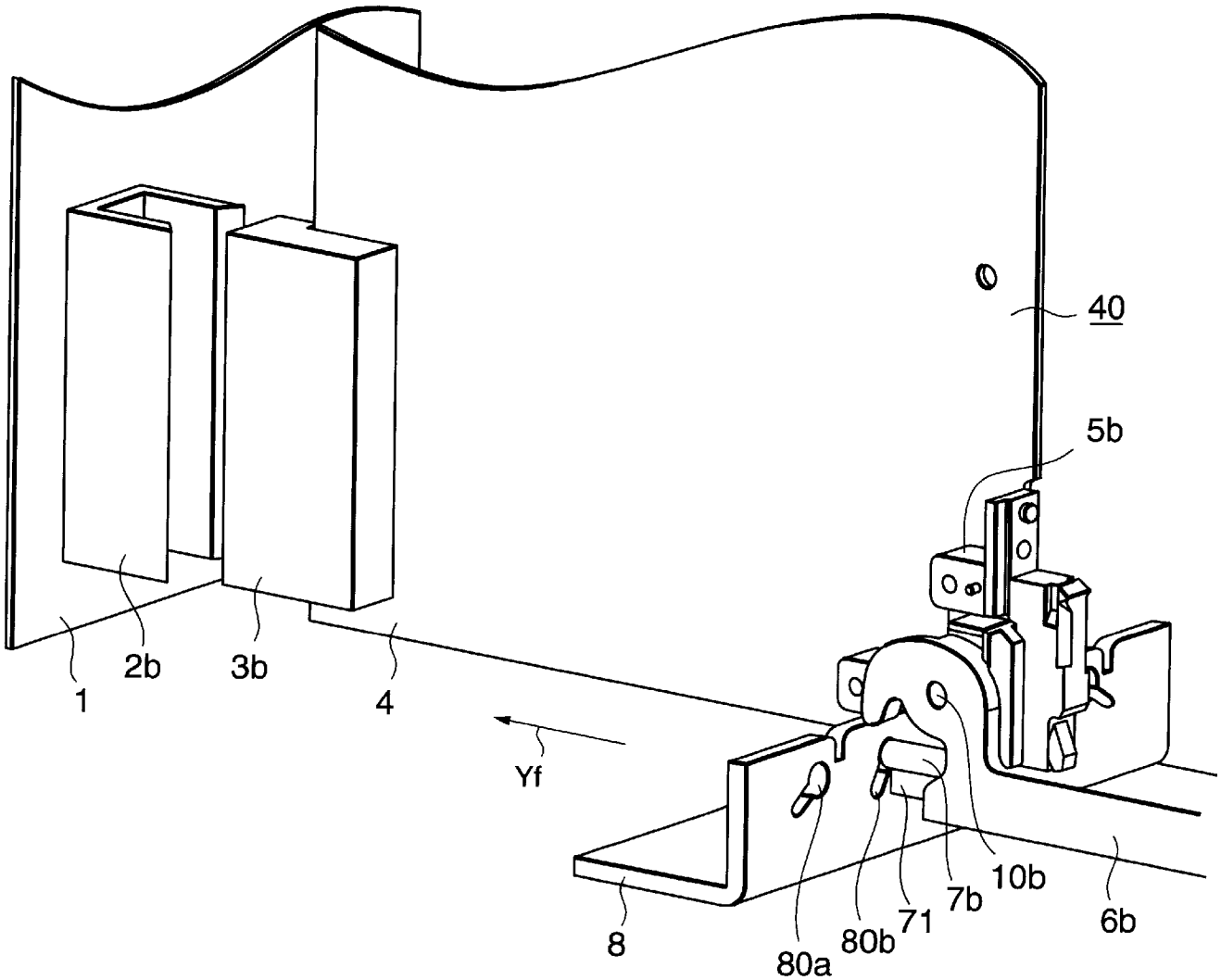
FIG. 13 is a perspective view showing the plug-in unit the insertion of which is blocked.

FIG. 13 shows an example that the plug-in unit 40 is inserted from a wrong position. The flag 71 of the guide pin 7*b* is set so that it is fitted to the through hole 8*b* of the guide plate, however, the plug-in unit 40 is inserted onto the shelf from a position of the through hole 8*b* of the guide plate 8. The shape of the through hole 8*b* of the guide plate 8 is not fitted in a position of the flag 71 of the guide pin 7*b* and the receptacle connector 2*b* is prevented from being connected to the wrong plug connector 3*b*.

As described above, the guide pin provided with the flag at the end is installed in the plug-in unit so that the guide pin corresponds to plural through holes of the guide plate one to one and prevents the plug-in unit from being inserted onto the shelf from a wrong position. The guide pin also has a function for guiding the plug-in unit after it is inserted into the through hole of the guide plate. Plural guide pins are installed at the opening of the shelf and a through hole into which a specific guide pin is inserted may be also made in each plug-in unit. In the invention, the guide pin having the same structure can be applied to many plug-in units.

While the present invention has been described in connection with certain preferred embodiments, it is to be understood that the subject matter encompassed by the present invention is not limited to those specific embodiments. On the contrary, it is intended to include all alternatives, modifications, and equivalents as can be included within the spirit and scope of the following claims.

What is claimed is:

1. A mechanism for preventing a connector from being wrongly inserted, comprising:

a guide pin holder attached to a board provided with a connector;

a guide pin held in the guide pin holder so that the guide pin can be detached; and a guide plate installed at the opening of a shelf provided with a connector, wherein:

the guide plate has a through hole which a specific guide pin can pierce, and the guide plate has a slit into which a part of a board is inserted in the vicinity of the through hole.

2. A wrong insertion preventing mechanism according to claim 1, wherein:

a guide plate has plural through holes; and a specific guide pin pierces each through hole.

3. A wrong insertion preventing mechanism according to claim 2, wherein:

a guide pin holder is attached in the vicinity of one corner of a board; and a guide plate is installed on the side corresponding to the guide pin holder at the opening of a shelf.

4. A wrong insertion preventing mechanism according to claim 1, wherein:

the shape of a through hole corresponds to the specific sectional shape of the vicinity of the end of a guide pin.

5. A wrong insertion preventing mechanism according to claim 1, wherein:

a projection is formed in a radial direction of the guide pin at the end of the guide pin;

the guide pin is held in a guide pin holder so that the projection is set in any of predetermined plural positions; and plural through holes formed in the guide plate respectively have a shape corresponding to a specific position in which the projection of the guide pin can be set.

6. A wrong insertion preventing mechanism according to claim 1, wherein:

a lever attached to a board so that the lever can be turned is provided; and a connector of the board can be connected to a connector on a shelf by turning the lever and pressing a guide plate.

7. A wrong insertion preventing mechanism according to claim 6, wherein:

a connector of a board can be pulled out from a connector on a shelf by turning a lever and pressing a guide plate.

8. A wrong insertion preventing mechanism according to claim 1, wherein said guide pin holder is attached to a first corner of said board and further comprising a second guide pin holder attached in the vicinity of a second corner of said board; and a guide plate is installed in a position corresponding and mutually opposite to each of the guide pin holders at the opening of a shelf.

9. A wrong insertion preventing mechanism according to claim 8, wherein each guide plate comprises plural through holes where the plural through holes have different shaped openings.

10. A wrong insertion preventing mechanism according to claim 1, wherein:

a projection is formed in a radial direction of the guide pin at the end of the guide pin.

11. A wrong insertion preventing mechanism according to claim 10, wherein:

a guide pin is held in a guide pin holder so that the projection is set in any of predetermined plural positions.

12. A wrong insertion preventing mechanism according to claim 11, wherein:

the through hole of a guide plate corresponds to the sectional shape in the vicinity of the end of a guide pin the projection of which is set in a specified position.

13. A wrong insertion preventing mechanism according to claim 11, wherein:

the guide pin inserting hole of a guide pin holder has plural slits; and a guide pin has projections corresponding to the slits.

* * * * *